United States Patent [19]

Dell

[11] 4,028,229

[45] June 7, 1977

[54] FROTH FLOTATION

[75] Inventor: Christopher Cambridge Dell, Leeds, England

[73] Assignee: National Research Development Corporation, London, England

[22] Filed: Mar. 14, 1975

[21] Appl. No.: 558,499

[30] Foreign Application Priority Data

Mar. 22, 1974 United Kingdom ..... 12857/74
Jan. 17, 1975 United Kingdom ..... 02128/75

[52] U.S. Cl. ..... 209/164; 209/169; 209/170; 210/221 R

[51] Int. Cl.[2] ..... B03D 1/22

[58] Field of Search ..... 209/164, 165, 168–170; 261/87, 93; 210/221 R, 221 P, 221 M

[56] References Cited

UNITED STATES PATENTS

| | | | |
|---|---|---|---|
| 1,141,377 | 6/1915 | Callow | 209/170 |
| 1,283,159 | 10/1918 | Groch | 261/87 X |
| 1,389,674 | 9/1921 | Lyons | 209/169 |
| 1,407,258 | 2/1922 | Connors | 210/221 P X |
| 2,104,349 | 1/1938 | MacCamy | 209/169 |
| 2,167,788 | 8/1939 | Weinig | 209/169 |
| 2,246,560 | 6/1941 | Weinig | 209/169 X |
| 2,451,144 | 10/1948 | Aubrey | 210/221 M X |

FOREIGN PATENTS OR APPLICATIONS

| | | | |
|---|---|---|---|
| 96,217 | 10/1923 | Austria | 209/169 |
| 47-6202 | 2/1972 | Japan | 210/221 |
| 920,172 | 8/1963 | United Kingdom | 209/168 |
| 296,593 | 4/1971 | U.S.S.R. | 209/168 |

*Primary Examiner*—Frank W. Lutter
*Assistant Examiner*—Ralph J. Hill
*Attorney, Agent, or Firm*—Oblon, Fisher, Spivak, McClelland & Maier

[57] ABSTRACT

A method of effecting froth flotation in a receptacle divided by separating means to provide a plurality of flotation cells arranged one above another comprises passing froth upwardly from a first cell into a second cell situated thereabove while controlling the thickness of the froth layer in the first cell to correct variations therein and thereby inhibit coalescence. Apparatus for use in said method comprises a receptacle divided by separating means to provide a plurality of flotation cells arranged one above another, said separating means being adapted to provide, in operation, passage means for the passage of froth upwardly from a first cell into a second cell situated thereabove, the first cell having control means which acts to control the thickness of the froth layer in the cell in response to a variation in the thickness of said layer.

21 Claims, 8 Drawing Figures

Fig. 1.

FROTH FLOTATION

This invention relates to methods of froth flotation and apparatus for use therein.

The degree of beneficiation of a material achieved by froth flotation in a single flotation cell can be improved by the use of a plurality of separate cells, the froth from one cell being passed to the next in which it is refloated. Two examples of such multi-stage flotation processes and apparatus for use therein are described in U.S. Pat. Nos. 1,958,325 and 3,428,175. In order particularly to mitigate the cost of such an operation, which increases substantially in proportion to the nunber of cells employed, I proposed over twenty years ago in U.K. patent specification No. 735,237 the use of a multi-stage froth flotation process employing a receptacle which is divided to provide a plurality of cells positioned one above the other, the froth being passed upwardly from one cell to another. However, neither the form of apparatus proposed in that specification nor those which I proposed in UK patent specification No. 926,172 have proved satisfactory for effecting such a vertical multi-stage froth flotation process, and despite the potential advantages of such a method, it has never been developed.

It is an object of the present invention to provide an improved method and apparatus for effecting multi-stage froth flotation using a plurality of vertically disposed cells.

According to the present invention a method of effecting froth flotation in a receptacle divided by separating means to provide two or more flotation cells arranged one above another comprises passing froth upwardly through the separating means from a first cell into a second cell situated thereabove whilst controlling the thickness of the froth layer in the first cell to correct variations therein and thereby inhibit colescence.

The present invention derives from an appreciation of the conditions which are required in the cells of a multi-stage froth flotation apparatus employing a plurality of vertically disposed cells if it is to function satisfactorily. Thus, it has been found that for successful operation it is of considerable importance that coalescence of the bubbles in the froth layer of any but the uppermost cell should be minimised. The rate of coalescence is proportional to the residence time of the bubbles in the froth, which in turn is proportional to the thickness of the froth, so that by controlling the thicknes of the froth layer in a cell to correct variations therein and maintain it at a selected value appropriate to the flotation being performed, coalescence can be avoided to a substantial degree. It will be appreciated that whilst it may not be possible to totally eliminate variation in the thickness of froth in a cell, the present invention is directed to the control of such variations to restore the thickness to the desired value and maintain an overall value for the thickness which is substantially constant, it being particularly desirable to control any increase in the thickness of the froth layer from the selected value. However, the method of the present invention does not exclude the operation of a froth flotation process in a manner such that after maintaining the layer at a selected thickness for a desired period, this selected thickness is adjusted to an alternative value which is then maintained for a further period.

As described in U.S. Pat. No. 3,471,010, it is common practice when carrying out a multi-stage froth flotation in a series of individual cells to control the pulp level in each cell, and devices for this purpose are described in that specification, in U.S. Pat. No. 3,255,882 and in U.S. Pat. Nos. 1,958,325 and 3,428,175 which have already been referred to above. However the aim in operating such a multi-stage froth flotation apparatus as described in these U.S. specifications is to effect coalescence in the froth layer of each cell in order to improve froth grade. The concept of effecting froth flotation with the aim of minimising coalescence, as applied in the present invention to a quite different form of multi-stage froth flotation apparatus comprising a receptacle divided by separating means to provide two or more flotation cells arranged one above another, is thus in complete contra-distinction to the usual practice in this art.

The avoidance of random variations in the thickness of the froth layer in a cell may be avoided by the use of a control mechanism which responds to any slight deviation from the selected figure to rectify this deviation, thereby maintaining the selected thickness.

The present invention thus further includes apparatus for use in froth flotation which comprises a receptacle divided by separating means to provide two or more flotation cells arranged one above another, said separating means being adapted to provide, in operation, passage means for the passage of froth upwardly through the separating means from a first cell into a second cell situated thereabove, the first cell having control means which acts to control the thickness of the froth layer in the cell in response to a variation in the thickness of said layer.

Conveniently, apparatus according to the present invention comprises more than two, for example, three, four or more, flotation cells. In order to produce a froth, one or more gas bubble generating means are required, for example in the form of an air inlet, positioned in appropriate relation to some form of agitating means located in the lowest of the cells, which provides for the mixing of a supply of fine bubbles with the feed pulp fed into this cell. Various forms of agitating means may be employed, including a vibrating perforated plate and an impeller mounted upon a rotating vertical shaft inserted downwardly through the various cells of the apparatus. A form of agitating means of particular interest, however, is that comprising an impeller mounted upon a rotating vertical shaft inserted upwardly into the lowest cell through a seal in the base thereof which prevents leakage of pulp from the cell, for example by the use of V-rings. Such a form of agitating means leads to one advantageous form of turbulence in the lowest cell; the turbulence comprising two distinct zones, a lower one with a toroidial motion caused by the impeller and above it is quiescent zone with random motion. Linkage between the two zones may conveniently be controlled by the use of a baffle; a preferred form for such a baffle comprises a plurality of vertically disposed plates together with four horizontally disposed plates located in the corners of the cell. For ease of fixation the various components of the baffle may be linked together. If desired, additional sources of agitation may be provided higher in a column of cells, for example by vibration of a perforated separator dividing two cells, but it has been found possible to operate a column quite satisfactorily with only rotating impeller positioned in the lowest cell. It will be appreciated that flotation apparatus according to the present invention may be formed by mounting a column of vertically disposed cells on to one of a number of types of flotation cell as the lowest cell of the apparatus, inluding various commercially available forms of cells, the turbulence in this lowest flotation cell being created in various ways.

Apparatus according to the present invention is preferably provided with inlet means for feeding a supply of fresh, reflux liquid into the uppermost cell and/or one or more upper cells, such an arrangement conveniently being associated with means for passing a flow of pulp downwardly through the apparatus and the supply of fresh liquid being controlled to regulate the quality of the froth in the apparatus. Thus a lower flotation cell is preferably provided with means for passing pulp downwardly into the cell from an upper cell, conveniently that into which the froth from the lower cell passes. Except in the case where the lower cell is the lowest of the apparatus, it will generally in turn be provided with outlet means for passing pulp downwardly out of the cell. The pulp inlet and outlet of a cell may be either external or internal, i.e. being positioned in a wall of the cell or through its ceiling and floor, respectively. In the case of an apparatus in which the cells are of substantially square cross-section an arrangement in which the pulp inlet and outlet are positioned at opposite sides of the cell, the inlet into the lowest cell being oppositely disposed to the feed inflow, has the advantage of providing an approximation to plug flow through the apparatus and minimising the possibility of short circuiting. In the case of an apparatus in which the cells are of pronouncedly rectangular cross-section, an arrangement employing a plurality of pulp inlets and outlets can have certain advantages as described hereinafter.

It is not, however, necessarily advantageous for all cells of the apparatus to be directly linked for pulp flow. Thus, for example, in order to avoid diluting the pulp in the lowest cell, the pulp from the cell situated adjacently thereabove may be led to a thickener in which water is removed by settlement, and the thickened slurry may be fed in with the new feed to the lowest cell. Furthermore, it can be advantageous to exclude the uppermost cell from such a linked arrangement so that the fresh liquid is fed into one or more of the cells beneath the uppermost cell, for example into that adjacent thereto, and there is no downward flow of pulp from the uppermost cell. This can be desirable, as feeding of the liquid into the uppermost cell and downflow of pulp therefrom can under certain circumstances lead to passage out of the uppermost cell of mineral which has dropped from the froth upon the coalescence of the bubbles which, in contrast to the other cells, does occur in this cell.

The control means of the apparatus may operate in various ways. As indicated above, a cell other than the uppermost or lowest of the cells is preferably provided with inlet and outlet means for allowing the passage of pulp downwardly into and out of the cell, respectively. In operation, for equilibrium in a cell centrally placed in the apparatus, the amount of material flowing into a cell as pulp and as froth is equal to the amount of material flowing out of it as pulp and as froth. Any variation in the thickness of the froth layer in a cell may, therefore, be counteracted through adjustment of one or more of rate of flow of froth into the cell, rate of flow of froth out of the cell, rate of flow of pulp into the cell and rate of flow of pulp out of the cell. The control preferably operates either on the pulp flow inwo the cell or the froth flow out of the cell. The situation in the lowest cell of the apparatus, is of course special, but conveniently the froth thickness may also be controlled through the pulp flow downwardly into the cell or the froth flow upwardly out of the cell.

The detailed mechanism of operation of the control means varies in different embodiments of the invention, particularly according to the form of the separating means. However, it is usually the case that the control means acts to decrease the flow of froth and/or pulp in the event of a decrease in froth thickness by restricting the respective passage means providing a passage way for these materials, and vice versa for an increase in flow. The control means thus usually comprises some form of valve means, i.e. a means providing an aperture or apertures of variable size at some part of the passage means. The valve means may itself be directly resposive to a change in froth thickness or alternatively the control means may additionally comprise some form of activating means for the valve means which is responsive to a change in froth thickness. It will be appreciated that various forms of sensor may be employed to detect the change in froth thickness, for example an ultrasonic transducer which can differentiate between froth and pulp, and which is set into the wall of the cell in the region of the froth/pulp interface. One particularly preferred form of sensor, in one way or another, responds to pressure changes in the apparatus consequent upon the presence of froth rather than pulp at the top of a cell.

As indicated above, the forms of control means and of separating means which are used are closely related. One general form of separating means comprises one or usually a plurality of apertures for the passage of froth which are of a constant size. Such a perforated separator may take one of many forms. Thus, although in a preferred form the apertures are frustro-conical or tapered with the wider end of the aperture adjacent to the froth layer at the top of the first cell, in other forms the apertures may be of constant cross-sectional area and may be substantially circular or alternatively may be substantially rectangular taking the form of slots. The cross-sectional area of individual apertures and the total aperture area will have an effect on froth thickness and should be selected in conjunction with the form of control means in relation to the type of material to be treated. Separating means containing apertures of constant size advantageously have the form of horizontal plates and, if desired, these may have seals arranged around their edges to prevent undesired movement of material from one cell to another. Such a general form of separating means as just described is more usually employed in a conjunction with a form of control means operating upon the pulp flow into or out of the cell, preferably the former, the control means conveniently being responsive to a variation in the pressure difference between the bottom of the second cell and the top of the first cell. A convenient arrangement of this type is thus for the pulp inlet to a cell to be controlled by valve means which opens to increase pulp flow if the thickness of the froth layer increases and vice versa, the valve means either being connected to, or itself constituting a sensor system which responds to the change in pressure between the bottom of the second cell and the top of the first cell consequent upon variation in the depth of the froth layer. It will be appreciated that when the pulp flow from the second cell into the first cell is restricted then the presence of the froth layer causes a further pressure drop across the separating means between the bottom of the second cell and the top of the pulp in the first cell which is additional to that arising from the loss of height. An increase in the thickness of the layer will therefore increase the pressure difference between the two cells, and vice versa.

One type of valve means utilises a member subject in operation to the opposing forces of the downward pressure of the pulp in the upper cell and the upward buoyancy pressure of the pulp in the lower cell, the member moving to derestrict the pulp inlet and increase pulp flow when an increase in froth thickness leads to an imbalance between these forces, and vice versa. Thus, for example, the member may comprise a ball of suitable material enclosed in a perforated cage and arranged so that on movement upwards the ball restricts the pulp inlet passage, and vice versa. Alternatively, the member may comprise a hinged member connected with a float of appropriate material arranged so that on upward movement the member restricts the pulp inlet, and vice versa.

A further form of valve operating upon the pulp inlet to a cell and which has the advantage of ready adjustability comprises a hinged weir contained in an external pressure chamber connecting an upper and a lower cell and over which, in operation, pulp flows downwardly between the two cells, movement of the weir actuating means for varying the air pressure in the chamber. The pressure controlling means may comprise, for example, a disc closing off an aperture in the wall of the pressure chamber and having an outer face which is acted upon by a first means such as a spring or weight and an inner face which is acted upon by a second means connecting the inner face of the disc with the weir, the efficiency of closure of the pressure chamber depending on the net effect of the two forces acting upon the disc. In operation,an increase in froth depth in the lower cell with which the pressure chamber connects causes an increase in the change of pulp level at the weir, which results in increased outward pressure on the disc and leads to a decrease in the air pressure in the chamber, thereby increasing the pulp flow over the weir due to the rise in liquid pulp level above the lip of the weir and restoring the froth depth to the desired value. A decrease in froth depth results in an opposite sequence of effects. By providing for adjustment of the force exerted on the disc by the first means and located such adjusting means externally to the pressure chamber, adjustment is readily possible during operation if it is desired to modify somewhat the thickness of froth layer to be maintained. An alternative form of valve means also capable of ready adjustability comprises a pressure sensitive valve which is connected to two pressure sensors located in the cell of which the froth layer thickness is to be controlled and in that from which pulp is flowing. The valve is set to open, thereby increasing the pulp flow, when the pressure difference between the two sensors rises above a selected value which corresponds to the pressure difference that exists when the froth layer is of the desired thickness, and vice versa. Such a valve means is readily amenable to adjustment during operation should it be desired to modify somewhat the thickness of froth layer to be maintained, adjustment being facilitated if the valve means instead of just the adjustment control thereof is located externally to the cell, i.e. if the inlet to the lower cell and the outlet from the upper cell are external.

Another general form of separating means comprises one or usually a plurality of apertures for the passage of froth which are of variable size, even to the extent of being closed at certain points in the operation of the apparatus. Such a perforated separator has certain advantages as compared with one in which the apertures are of constant size, for example often being more amenable to froth flotation with viscous froths. This form of separating means may be of various types, although preferably the size of the apertures vary in use according to the thickness of the froth layer beneath the separating means so that the rate of flow of froth through the apertures is increased if the thickness of the froth layer shows any tendency to increase, and vice versa. In such a case the means providing the separating means also provides, at least in part, the control means of the apparatus.

Most usually the separating means comprises a plurality of portions, at least one of which is movable to provide a plurality of apertures of variable size through which froth may pass, the size of the apertures being determined by the degree of movement. Thus, for example, the separating means may comprise a sheet of flexible material, for example of rubber, mounted on a rigid grid. By removing portions from the material to provide apertures, and making several slits in the sheet connecting with each aperture, the apertures will increase in size as pressure against the sheet increases.

One form of separating means with variable size apertures which is of some interest comprises a plurality of sections each of which is free to move in relation to adjacent sections to provide an aperture of variable size between one section and another. Whilst such a separation means may be constructed in various ways, it is more convenient if the apertures are linear rather than circular so that the separating means may conveniently comprise a plurality of rods which are free to move in relation to each other. Whilst the rods may be of various cross-sectional forms, they are most conveniently of circular cross-section. The series of rods is preferably positioned side by side transversely across the column, for example so that the longitudinal axis of the column is perpendicular to the plane containing the rods, the rods conveniently resting at each end of a supporting member attached to the interior wall of the column. If desired, however, a smaller number of additional rods may be positioned on top of those forming the main series. The number and size of the rods is selected to provide a suitable juxtaposition of each rod to its neighbour. Whilst this positioning may vary according to the use to which the apparatus is to be put, it may be stated as a guide that a suitable spacing between one rod and the next, when the rods are evenly spaced across the column, is of the order of 1mm in many instances. The rods may be of a specific gravity such that in use they substantially remain on the supporting members at all times and their movement consists of a continual lateral shuffling. Alternatively, they can be of a specific gravity such as to allow some lifting of the rods in use in addition to the lateral movement. The rods may conveniently be of a plastics material but, if desired, their overall specific gravity may be adjusted by the use of inserts, for example of a metal such as iron. If any difficulty is encountered with rods becoming crossed during operation this may be overcome by providing some form of constraint on the amount of movement allowed to the rods.

A preferred form of separating means with variable size apertures comprises a first portion containing a plurality of apertures and a second portion arranged to restrict said apertures, the second portion being movable in relation to the first in order to vary the size of the apertures through the separating means in proportion to the degree of movement of the second portion. Such a form of separating means may be constructed in various ways. Thus, for example, the first portion of the separating means may contain a series of circular holes whilst the second portion consists of a corresponding series of spherical plugs which co-operate with the holes. If desired, the spherical plugs may carry an additional anchor weight. Alternatively, the first portion may contain a series of slots whilst the second portion consists of a corresponding series of hinged members which co-operate with the slots.

A particularly favoured arrangement employs a first portion which comprises a plurality of sections arranged to provide apertures between one section and another. Preferably the sections are of linear form to provide linear apertures or slots. Conveniently, therefore, the first portion comprises a plurality of rods held at a spaced distance apart by fixture in the column or in a frame which is removable from the column. The rods may be of various cross-sectional forms, for example circular, square or rhomboidal, and are preferably arranged so that the longitudinal axis of the column is perpendicular to the plane containing the rods. Conveniently, the rods of each separating means are arranged at right angles to those of adjacent means. The first portion comprising a plurality of sections conveniently co-operates with a second portion which also comprises a plurality of sections which, when the second portion has not been pushed upwards by the operation of the apparatus, rest in apertures between the sections of the first portion. It will be appreciated, therefore, that the apertures in such separating means may sometimes be fully closed. Preferably, however, the first and second portions may be adapted so that at rest the apertures are not fully restricted. Preferably the section of both the first and second portions are linear and conveniently, therefore, the second portion comprises a plurality of rods which are movable in relation to a plurality of rods comprising the first portion to provide apertures through the two series of rods which vary in size according to the degree of movement of the rods of the second portion relative to those of the first portion. It has been found that it is even possible to omit a rod of the second portion without unduly upsetting the operation of the apparatus. Each rod of this second series of rods is conveniently independent of the others, although some form of constraint may be provided, if desired, to prevent complete detachment of the second series of rods from the first, for example some form of grid. The rods of the first series conveniently carry a raised portion around their circumference at each end to prevent full restriction of the apertures between the two series of rods when a rest. The rods of the second series, like those of the first series, may also be of various cross-sectional forms and these may, if desired, be different from that of the rods of the first series. Thus, for example, the fixed rods may be of square or rhomboidal cross-section arranged with their diagonal axes vertical and horizontal, whilst the movable rods are of circular cross-section. In order to avoid uneven packing of the rods it is preferred that the rods of both series are linear and a parallel and that such an arrangement is maintained in use. Conveniently, therefore, in constructing the rods, their dimensions should be selected in relation to the material from which they are constructed so as to prevent any substantial deviation from linearity. It has been found that the movable rods are less likely to become jammed against the walls of the column if their ends are substantially either spherical or conical in shape. Furthermore, roughening of the exterior of the rods can be advantageous in discouraging coalescence. These considerations apply also to the separating means described above comprising a series of rods, each of which is movable.

In some cases, for example with a separating means comprising a single series of rods, all of which are movable, it may be most convenient for the downflow of pulp from said second cell into said first cell to occur through the separating means, and for no separate means for pulp flow to be provided. In such a case, the flow of pulp as well as the flow of froth is conveniently controlled in accordance with any tendency of the thickness of the froth layer to vary. However, in other cases, for example with a separating means comprising a fixed first portion and a movable second portion, although the downward flow of pulp may also be through the separating means if desired, it may be more convenient for a separate means to be provided for passing pulp downwardly from the second cell to the first. This may take various forms, for example being provided by a gap between the end rods of a series and the interior walls of the apparatus or by an aperture formed through each rod at right angles to the axis thereof. Alternatively some form of passage means for the transfer of pulp external to the cells may be employed. The separate means for pulp transfer may contribute to the maintenance of the froth thickness via control of pulp flow, for example incorporating one of the forms of control means described for such a purpose above. However, more preferably, the means merely provides for an unrestricted downward flow of pulp.

In order for the size of the apertures of the separating means to vary in use in accordance with the thickness of the forth layer it may be necessary to match the size and density of the movable portion of the separating means to the nature of the pulp to be treated in the column and the froth thickness required in operation. Thus, for example, with separating means comprising a first portion containing a plurality of apertures and a second movable portion arranged to restrict said apertures, particularly when this is used together with a separate means providing an unrestricted pulp flow, the second portion of the separating means is preferably of a form such that in use the total weight in the pulp of the suspended material, i.e. of the second portion of the means plus the liquid and the solids in the froth, is equal to the weight of pulp displaced by the presence of a froth layer of the required thickness. Under these circumstances an increase in the thickness of the froth layer will lead to a net upward force on the second portion moving it away from the first portion, and thereby increasing the aperture size and upward flow of froth, thus restoring the froth layer to the required thickness, and vice versa for a decrease in the thickness of the froth layer.

Whilst the optimum size and density of the second portion of the separating means will vary according to the use to which the apparatus is to be put, some general guidance can be given which is of particular relevance to apparatus in which a series of rods is used as the second portion (the size then being dependent upon the cross-sectional area). It is, of course, the case that for any pulp the smaller the cross-sectional area of the rods (diameter in the case of a rod of circular cross-section) and the smaller their density, the smaller will be the forth thickness obtained with those rods. However, consideration should also be given to which of these two parameters is varied to obtain a different froth thickness. Thus a rod of relatively small cross-sectional area constructed of a material of relatively high specific gravity has the advantage, as compared with a rod of higher-cross-sectional area constructed of a material of a lower specific gravity which is closer to that of the pulp, that it is less sensitive to changes in the specific gravity of the pulp during use and therefore provides a better overall level of efficiency in this respect. A small number of rods of large cross-sectional area is however more robust than a large number of rods of small cross-sectional area and a balance must be struck between these two factors in selecting the type of rods to be used for the treatment of any particular pulp. Plastics material are particularly suitable for the construction of the rods, for example nylon, polypropylene, etc. and these may contain inserts, for example of a metal such as iron, to increase their overall density. For greater versatility the rods may be constructed so that the inserts can be varied. The overall specific gravity of the rod is, of course, selected with a view to the type of pulp to be treated in order to provide a value suitably in excess of that of the pulp. As a guide, however, a value of about 1.1 to 1.3 is suitable in a number of instances.

As indicated above, conveniently at least a proportion of the cells in the apparatus are linked so that pulp can flow downwardly through the column. It is desirable to maintain either a constant overall head in the apparatus or, more preferably, a constant level in the uppermost cell in order to provide a steady rate of outflow of froth. These two parameters are affected by inflow of fresh liquid, the inflow of feed pulp, the outflow of tailings and the outflow of froth. Most conveniently, control of the parameters may be achieved by providing control means for control of the outflow of tailings. One method of control of tailings outflow involves the use of an exit from the bottom of the apparatus into an external column of adjustable height over the top of which the tailings flow, a bleed hole conveniently being provided at the bottom of the external column to control silting up. Usually, however, a somewhat closer level of control of tailings outflow is employed, for example by arranging for a variation for in the rate of outflow to be actuated by a variation in the overall head of the apparatus or the level in the uppermost cell. Various arrangements may be used to effect this including a diaphragm valve directly sensitive to pressure through the whole apparatus or in the uppermost cell, for example a modified form of Saunders valve, or a valve activated by some form of pressure sensitive control located either at the bottom or top of the column. In order to prevent silting up when turned off, the seating of any valve should preferably be hard against the wall of the lowest cell. A further alternative comprises some form of plug valve means in the base of the lowest cell, for example one of the commercially available froms of plug valve, which is either directly responsive to the position of the froth layer or manually controlled. A convenient arrangement is for the plug to be operated by a solenoid control which is preferably resposive to a pressure sensitive means located at the top of the apparatus.

Froth collection from the uppermost cell may be effected by various methods. It is preferable, however, that the method used should substantially avoid any fall back of material contained in the froth into the column. One possible method involves the use of a sloping roof on the uppermost cell having an angle of, for example, from about 40° to 50°, an exit for the froth into a collector being provided only at the apex of the cell. A second, preferred method involves the use of a scraper to remove the froth from an uppermost cell which is open-topped.

For continuous, as opposed to batch operation, it may be convenient to employ apparatus whose dimension in the direction of feed pulp flow into the apparatus is several times larger than either dimension transverse to this direction. Such an arrangement allows a gradation of separation to occur along the lowest cell and if a plurality of pulp inlets and pulp outlets, conveniently of the internal type, is employed spaced in the direction of the largest dimension of the cell, this gradation can be maintained upwardly throughout the column of cells. Such an arrangement will correspond essentially to a plurality of columns, for example up to eight or even more, placed side by side and interlinked so that flow occurs horizontally from column to column as well as vertically through each column. The froth from various sections of the uppermost cell of such an apparatus may be collected separately and, if desired, means may be incorporated for effecting rejection of the froth from any section in which the proportion of the desired material is insufficient. A plurality of impellers may be used in such an apparatus, for example one to each two linked column units.

The present invention may be applied to the concentration of a wide variety of particles in liquid suspension, such as the cleaning of fine coal and treatment of metalliferous ores such as sulphide ores or non-metallic ores such as fluorospar. The method will almost invariably be applied to the production with air of a froth from aqueous suspensions. Collectors, depressants and the like may be used which are appropriate to the particular separation being effected.

As explained above, when employing separating means comprising a plurality of portions, at least one of which is movable to provide apertures of variable size through which froth may pass, the operation of the apparatus is often best where the nature of the movable portion of the separating means is related to the specific gravity of the pulp being treated. For this reaction it is preferred that any large variations in pulp density are avoided and the pulp flow into the column may conveniently be treated to avoid any substantial variation in density.

Wilst conditions appropriate to any particular separation must be chosen, a froth layer thickness in each cell but the uppermost of from about 0.5 to about 1.5 cm, for example from about 0.9 to about 1.1 cm, i.e. about 1 cm, is suitable in many cases.

It will be appreciated that the residence time of the air bubbles in the froth layer of a flotation column and thus the rate of coalescence of these bubbles is proportional not only to the thickness of the froth layer but is also proportional to the cross-sectional area of the froth and inversely proportional to the volumetric flow of air flow through the froth layer. It is therefore important to bear in mind that an alteration in either of these parameters will influence the residence time. Conversely, it is possible to increase froth depth without increasing residence time if the froth area is correspondingly reduced.

Whilst the best forms of control means may exert a substantial measure of control of froth thickness even in the presence of considerable variation in such parameters as the air flow rate and the feed pulp density it will be appreciated that for the most efficient operation such parameters as this should be varied as little as possible during a run.

The invention is illustrated by the accompanying drawings which are diagrammatic in nature and not to scale, and of which FIG. 1 shows a sectional elevation of an apparatus according to the invention particularly suitable for batchwise operation;

Figure 5:
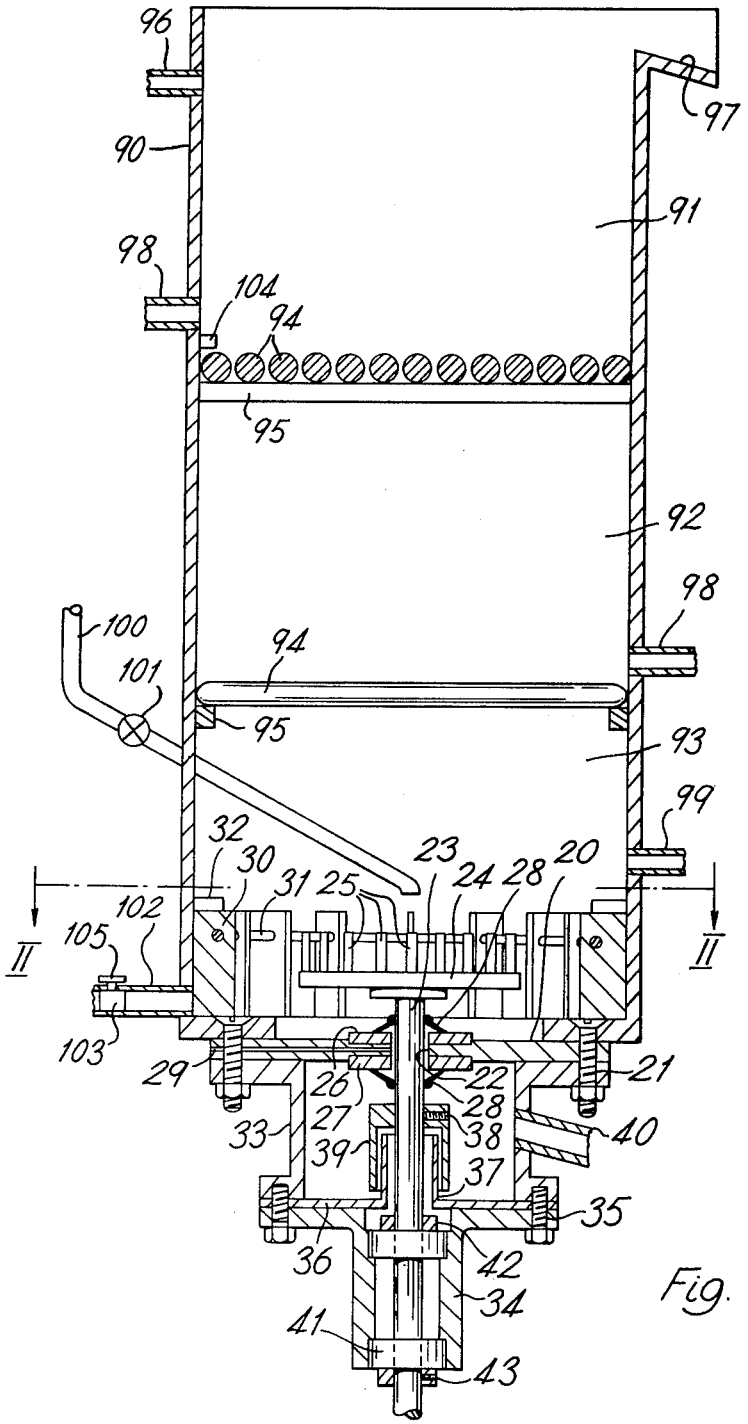
FIG. 5 shows a sectional elevation of an alternative form of apparatus to that of FIG. 1 which is also particularly suitable for batchwise operation.
Figure 6:
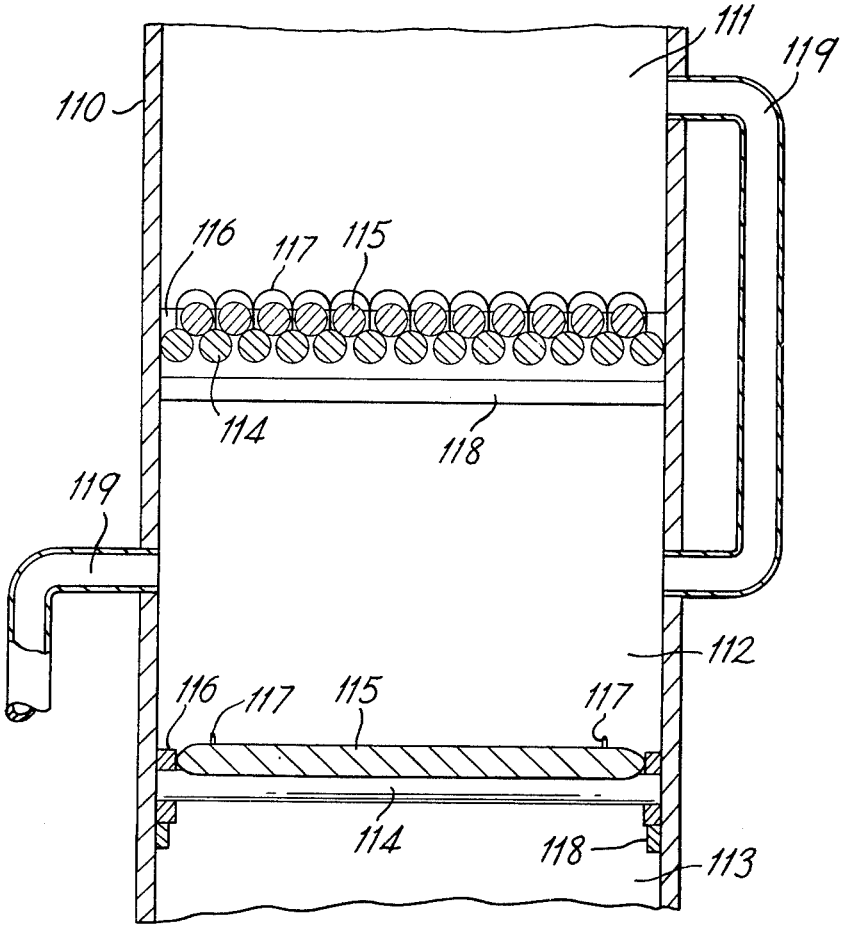
FIG. 6 shows a sectional elevation of the central part of an apparatus similar to that of FIG. 5 but differing in the form of the separating means between the cells and the mode of downward pulp transfer from one cell to another.
Figure 7:
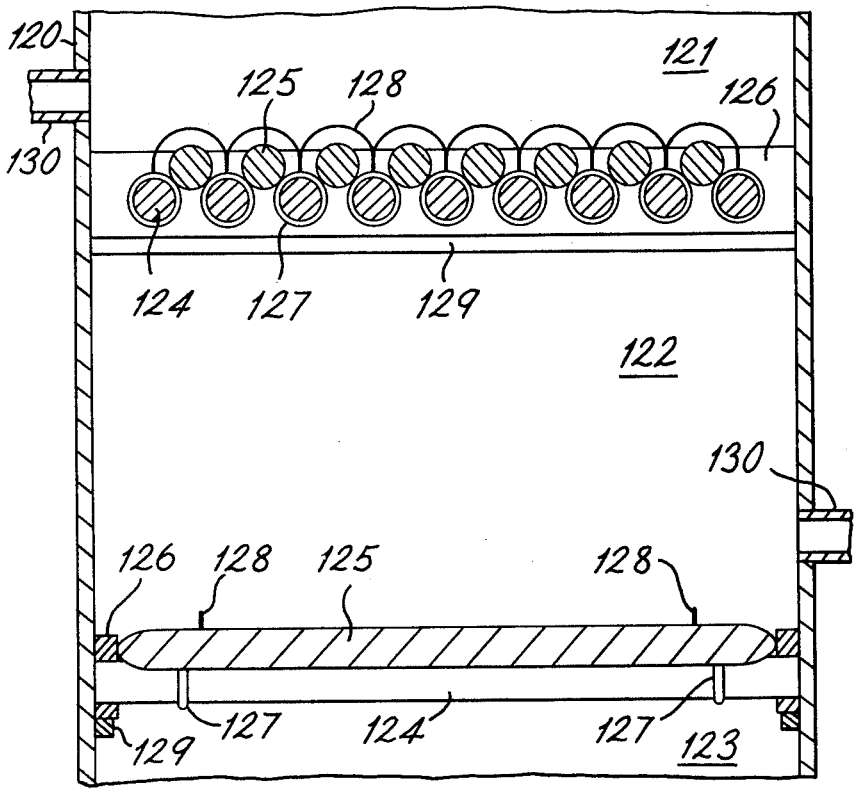
Figure 8:
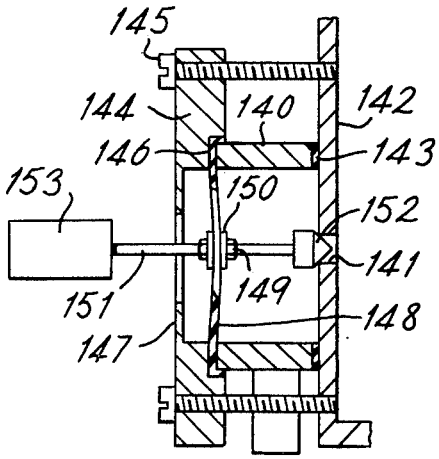

FIG. 7 shows a sectional elevation of the central part of another apparatus similar to that of FIG. 5 but differing from the apparatus of FIG. 5 and FIG. 6 in the form of the separating means between the cells and the mode of downward pulp transfer from one cell to another; and FIG. 8 shows in detail as a sectional elevation a further form of trailings outlet control valve suitable for use in the apparatus of any of the other Figures.

Figure 1:
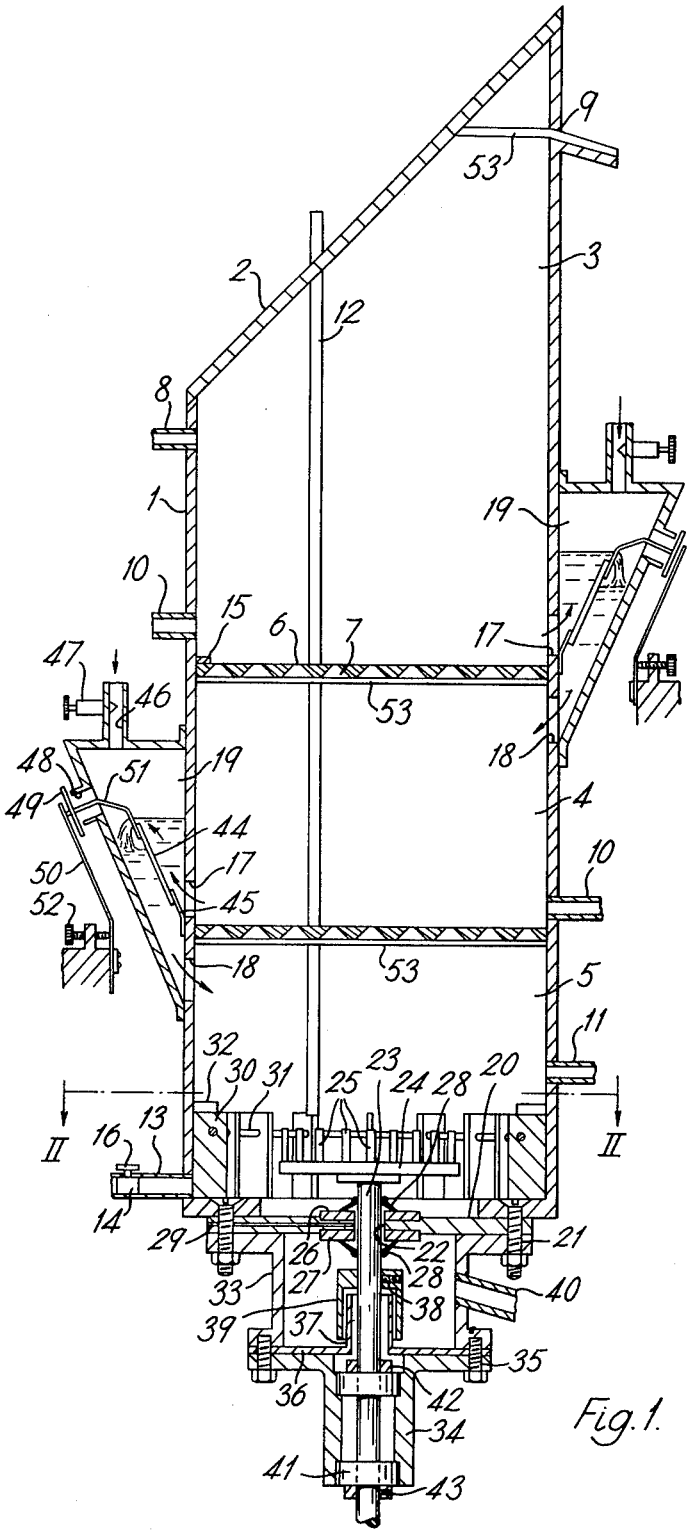
Figure 2:
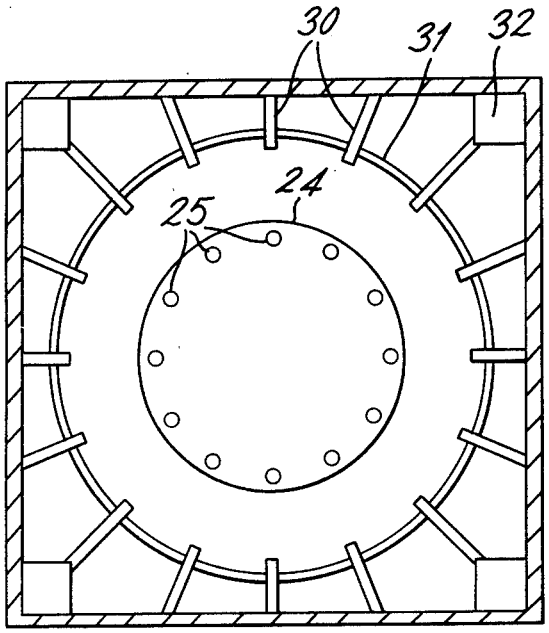
FIG. 2 is a section on the line II—II of FIG. 1 showing in detail the baffle plate of the apparatus of FIG. 1.

The apparatus of FIGS. 1 and 2 is shown in use, whilst the apparatus of the other Figures is shown empty.

In FIG. 1, a receptacle 1 having a detachable sloping roof 2 is divided internally into three flotation cells 3, 4 and 5 by plates 6 perforated by conical holes 7 having their more restricted end uppermost and which allow the upward flow of froth. An inlet 8 for fresh water and an outlet 9 for froth are provided in the upper cell 3 and sample ports 10 are provided in cells 3 and 4. An inlet 11 for feed and an inlet 12 for compressed air are provided into the lowest cell 5, the inlet 12 running vertically downward through the receptacle 1 and being offset from the centre in both directions. An outlet 13 from the cell 5 is provided for tailings. Exit of the tailings is controlled by a valve 14 located in the outlet 13 and connected to a sensor 15 which records the hydrostatic pressure in the upper cell 3, the valve 14 being adjustable by a control 16 to open automatically when this pressure rises above the set value and vice versa. Outlets 17 in cells 3 and 4 interconnect with inlets 18 in cells 4 and 5 via chambers 19 for transfer of pulp downwardly through the receptacle.

The base of the receptacle 1 is closed by a thick Parspex plate 20 attached to the receptacle by bolts 21. Inserted into the receptacle 1 through a aperture 22 at the centre of the Perspex plate 20 is a shaft 23 which carries a large low speed impeller comprising a plate 24 with upwardly directed pegs 25 detachably attached thereto. Attached by adhesive to recesses in the top and bottom of the Perspex plate 20 and surrounding the shaft 23 are hardened boronised steel discs 26 and 27. Also surrounding the shaft 23 are a pair of oppositely directed rubber V-rings 28 which make contact with the discs 26 and 27. Extending horizontally through the Perspex late 20 from the exterior thereof to the aperture 22 is a lubricating hole 29 for the supply of grease to the shaft 23. Mounted towards the bottom of the lower cell 5 is a baffle (shown in detail in FIG. 2) comprising sixteen vertically disposed rectangular plates 30 jointed by element 31 and four horizontally disposed square plates 32 located one at each corner of the cell 5. Beneath the Perspex plate 20 the shaft 23 is surrounded by a cylindrical leakage pot 33 mounted by the bolts 21 against the plate 20, and by a bearing housing 34 mounted by bolts 35 beneath pot 33. The pot 33 and housing 34 are separated by a plate 36, also mounted by the bolts 35, having a collar portion 37 directed into the pot 33 and through which the shaft 23 passes. Mounted around the shaft 23 and secured thereto by a screw 38 is a cylinder 39, the one open end of which surrounds the collar 37. This arrangement prevents any leakage of liquid into the bearing housing 34. Drainage of any liquid leaking into the pot 33 is provided by a spout 40. The housing 34 contains bearings 41 secured in position by collars 42, each attached to the shaft 23 by a screw 43.

The chambers 19 providing for pulp transfer from one cell to another contain a weir 44 attached at its lower end by a hinge 45 to the exterior of the receptacle 1 between the outlet 17 and the inlet 18. An inlet 46 closed by a restrictor 47 provides for the introduction of low pressure air into the chamber 19. An air outlet 48 from the chamber 9 has a ground exterior surface and is closed by a disc 49. The efficiency of the seal between the disc 49 and the ground surface of the outlet 48 is controlled by the action of a spring 50, which bears on the exterior of the disc 49, and the action of the rod 51 attached at one end to the interior of the disc 49 and at the other end of the upper end of the weir 44. The pressure exerted on the disc 49 by the spring 50 may be varied through the action of a control 52.

The froth layers in each cell are indicated as 53 but no attempt has been made to show the individual air bubbles rising through the apparatus.

In an alternative form of apparatus very closely similar to that of FIGS. 1 and 2, the following relatively minor modifications are made;

a. The roof 2 is replaced by an open top to the receptacle 1 similar to that shown for the apparatus of FIG. 5;

b. The valve 14 is positioned more closely to the wall of the receptacle 1 at the inner end of the outlet 13;

c. The sensor 15 is positioned on the interior wall of the receptacle 1 as with the sensor 104 of the apparatus of FIG. 5; and d. The spout 40 is positioned lower in the pot 33 nearer the plate 36 which forms the base of the pot 33.

In operation of the apparatus of FIGS. 1 and 2, or of the alternative form thereof just described, the receptacle 1 is first filled with water mixed with an appropriate amount of a suitable frother, and fresh reflux water is continuously fed in through the inlet 8 whilst the feed pulp containing the material to be treated is fed in batchwise through the inlet 11. The tailings from the outlet 13 are passed back into the receptacle as feed through the inlet 11, this procedure being repeated until the tailings contain no material of interest. Additional frother and any other desired additives, for example a collector oil, may be included in the feed as necessary. The receptacle 1 is then operated with additional frother being fed in with the fresh water until no further material of interest from the batch of feed pulp is contained in the froth leaving the upper cell 3 through the outlet 9. The thickness of the froth layers 53 in cells 4 and 5 is automatically controlled during operation by the action of the weir 44. Thus if the froth level decreases in thickness this will lead to a decrease in the change of pulp level at the weir 44 which will in turn lead to a reduction in the outward force exerted against the disc 49 by the weir 44 though the rod 51. The disc 49 will thereby create a more efficient seal against the air outlet 48 causing the air pressure in the chamber 19 to rise. The increased air pressure will lead to a decreased pulp flow over the weir 44 due to the fall in the liquid pulp level above the lip of the weir and thus the froth depth will be restored to the desired value. An increase in froth depth results in an opposite sequence of events.

Figure 3:
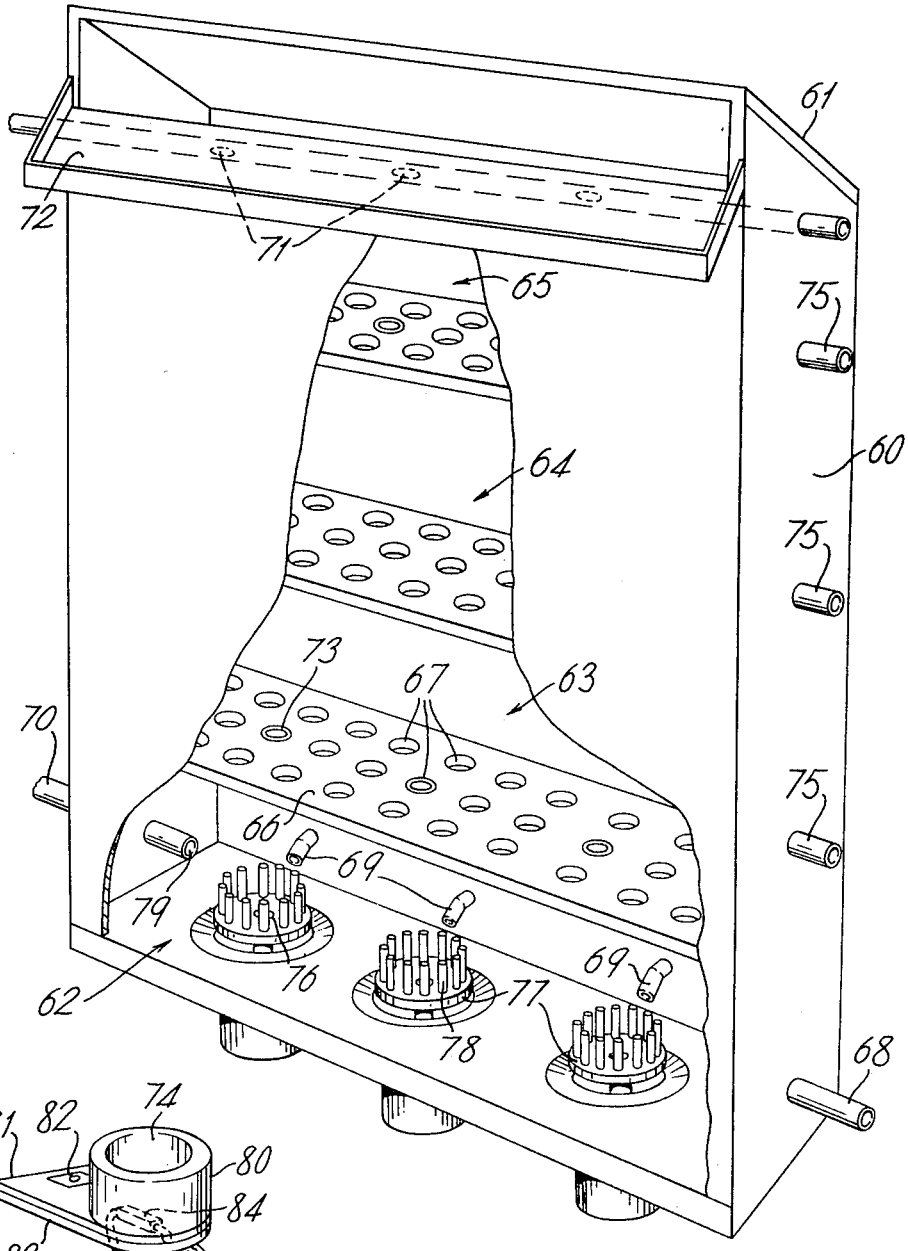
FIG. 3 shows a perspective view of an apparatus according to the invention particularly suitable for continuous operation.

Whilst the conditions used will vary, depending on the material being treated, the following conditions are given by way of example:

aperture size (top) : 2cm$^2$
froth layer : 1 cm (limits of variation 0.5 to 1.5 cm, preferably 0.9 to 1.1cm)
impeller speed for 6.5 cm diameter impeller : 1500 rmp
frother dosage (in fresh reflux water and feed) : 0.1 kg/ton
air flow rate : 1 liter/min for each 30cm$^2$ of foam
residence time from start to finish : 5 to 10 minutes In FIG. 3, a receptacle 60 of rectangular cross-section with a detachable sloping roof 61 is divided into four flotation cells 62, 63, 64 and 65 by plates 66 perforated by conical holes 67 having their more restricted end uppermost. An inlet 68 is provided into the lowest cell 62 for feed and inlets 69 are provided into the cell 62 for compressed air. An outlet 70 from the cell 62 is provided for tailings. Inlets 71 are provided into the uppermost cell 65 for fresh water and an outlet 72 from the cell 65 is provided for the froth overflowing from the cell. Three passageways 73 in each of the plates 66 provide for the downward flow of pulp from one cell to another, each passageway 73 containing a valve assembly 74 (not seen in FIG. 3 but shown in detail in FIG. 4). Sample ports 75 provide for sampling during operation of the column.

Inserted into the lowest cell 62 through the base of the receptacle 60 are three shafts 76 each of which carries an impeller comprising a plate 77 and pegs 78 detachably attached thereto, the impellers each being provided with a driving means and seal and catchpot arrangement similar to that described for the apparatus of FIG. 1. A diaphragm valve 79 is located at the exit point of the outlet 70 from the cell 62 which responds directly to the pressure head in the receptacle 60 to control the flow of tailings through the outlet 70.

The valve assembly 74 consists of a brass tube 80, which is a push fit into the passageways 73, mounted upon a brass plate 81. Attached to the plate 81 by the nut and bolt arrangement 82 is a rubber flap 83. Mounted on the flap 83 centrally beneath the tube 80 is a Perspex stud 84 to which is attached a curved wire 85 carrying a cylinder 86 of a buoyant material. Before operation, the shape of the wire 85 and thus the position of the cylinder 86 is adjusted so that in opertion with the froth layer at the desired thickness the tendency of the pulp pressing against the flap 83 to open it is exactly balanced by the buoyancy force exerted by the wire 85 to close it. If the thickness increases, the buoyancy force decreases and the flap 83 opens to admit pulp to the cell to decrease the thickness once more, and vice versa. Operation of the apparatus otherwise proceeds in a generally similar manner to that of FIG. 1 but with feed pulp continuously being fed in through the inlet 68 and the tailings being discarded from the outlet.

Figure 4:
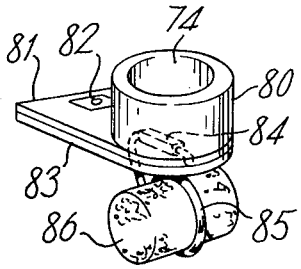
FIG. 4 is a perspective view showing in detail one of the control valves of the apparatus of FIG. 3.

In an alternative form of apparatus very closely similar to that of FIGS. 3 and 4, the following relatively minor modifications are made:

a. The roof 61 is replaced by a open top to the receptacle 60 similar to that shown for the apparatus of FIG. 5; and b. the spout from the impeller leakage pot is modified as described for the alternative form of apparatus to that of FIGS. 1 and 2.

Operation of this apparatus is similar to that of FIGS. 3 and 4.

In FIG. 5, a receptacle 90 is divided internally into three flotation cells 91, 92 and 93 by two series of rods 94 of plastics material, the rods 94 separating cells 91 and 92 being disposed at right angles to the rods 94 separating the cells 92 and 93. The rods 94 have conically shaped ends and in each series are supported at both ends by elongated support members 95 attached to the interior walls of the receptacle 90. An inlet 96 for fresh reflux water and an outlet 97 for froth are provided in the upper cell 91 and sample ports 98 are provided in cells 91 and 92. Removal of froth from the upper cell is aided by the use of a scaper (not shown). An inlet 99 for feed and an inlet 100 for compressed air are provided into the lower cell 93, the inlet 100 running into the cell 93 at a steep angle and containing a non-return valve 101. An outlet 102 from the cell 93 is provided for tailings. Exit of the tailings is controlled by a valve 103 located in the outlet 102 and connected to a sensor 104 which records the hydrostatic pressure in the upper cell 91, the valve 103 being adjustable by a control 105 to open automatically when this pressure rises above the set value and vice versa.

The lower cell 93 of the column 90 contains a baffle and impeller whilst the impeller drive shaft and its housing are mounted beneath the column. This portion of the apparatus is in all respects the same as in the apparatus of FIGS. 1 and 2, and for convenience the various parts are identified by the same numerals from 20 to 43 as used in FIGS. 1 and 2, a description of these parts being given in the description of the apparatus of these Figures.

In FIG. 6, a receptacle 110 is divided internally into three flotation cells 111, 112, and 113 by series of rods 114 and 115 of plastics material. The series of rods 114 and 115 are arranged in pairs, one pair of series separating cells 111 and 112 and another pair of series separating cells 112 and 113. Each pair of series of rods consists of a series of fixed rods 114 mounted between a pair of frame members 116 and a series of movable rods 115 which are conically shaped at each end and lie in the spaces between the fixed rods 114. The rods 114 and 115 separating cells 111 and 112 are disposed at right angles to those separating cells 112 and 113.

Excessive movement of the rods 115 is constrained by wire hoops 117 mounted between each rod 114 and its neighbours at both ends thereof. The whole assembly of rods 114 and 115 and frame members 116 is supported in each case by positioning of the members 116 on elongated support members 118 attached to the interior walls of the receptacle 110. Adjacent cells of the apparatus are connected by pipes 119 positioned on alternative sides of the apparatus. The other parts of the apparatus not shown in the Figure are in all respects the same as in the apparatus of FIG. 5 but have the lower of the pipes 119 connecting with cell 113 in the same fashion as the upper of the pipes 119 does with cell 112.

In FIG. 7, a receptacle 120 is divided internally into three flotation cells 121, 122 and 123 by series of rods 124 and 125 of plastics material. The series of rods 124 and 125 are arranged in pairs, one pair of series separating cells 121 and 122 and another pair of series separating cells 122 and 123. Each pair of series of rods consists of a series of fixed rods 124 mounted between a pair of frame members 126 with the rods 124 at the ends of the series being positioned to leave a gap between these rods 124 and the interior of the wall of the receptacle 120. The other rods of each pair of series are the movable rods 125 which are conically shaped at each end and lie in the spaces between the fixed rods 124 supported upon wire supports 127 wound round each fixed rod 124 at both ends thereof. The rods 124 and 125 separating cells 121 and 122 are disposed at right angles to those separating cells 122 and 123. Excessive movement of the rods 125 is constrained by wire hoops 128 mounted between each rod 124 and its neighbours at both ends thereof. The whole assembly or rods 124 and 125 and frame members 126 is supported in each case by positioning of the members 126 on elongated support members 129 attached to the interior walls of the receptacle 120. Each of the cells 121 and 122 contains a sample port 130. The other parts of the apparatus not shown in the Figure are in all respects the same as in the apparatus of FIG. 5.

In alternative forms of apparatus very closely similar to those of FIGS. 5, 6 and 7 the following relatively minor modification are made:

a. The valve 103 is positioned more closely to the wall of the receptacle 1 at the inner end of the outlet 102; and b. The spout 40 is positioned lower in the pot 33 nearer the plate 36 which forms the base of the pot 33.

In operation of the apparatus of FIG. 5, 6 or 7, or of the alternative forms thereof just described, the reflux water, feed pulp and tailings are handled in an exactly similar way to that described for the apparatus of FIGS. 1 and 2. In this instance the thickness of the froth layer in the middle and lower cells is automatically controlled during operation by the action of the movable rods 94, 115 or 125, downward passage of pulp through the receptacles being through the apertures between the rods 94 in the apparatus of FIG. 5 , through the pipes 119 in the apparatus of FIG. 6, and through the apertures between the rods 124 and 125 to some extent but primarily through the gaps between the rods 124 and the receptacle wall in the apparatus of FIG. 7.

Whilst the conditions used will vary, depending on the material being treated, the following conditions are given by way of example:

froth layer : 1 cm (limits of variation 0.5 to 1.5 cm, preferably 0.9 to 1.1 cm)
diameter of rods : 1.2 cm
separation of rods (FIG. 5) : 0.1 cm
specific gravity of rods : 1.3 (of less significance in FIG. 6)
air flow rate : 1 liter/min for each 30 $cm^2$ of foam
impeller speed for 6.5 cm diameter peller : 1500 rpm
frother dosage (in fresh reflux water and feed) : 0.1 kg/ton
residence time from start to finish : 5 to 10 minutes In FIG. 8, a cylinder 140 of Perspex surrounds a tailings outlet 141 formed in the wall 142 of the lowest cell of the receptacle. Contact between the cylinder 140 and the wall 142 is through an annular seal 143. The cylinder 140 co-operates at its outer end with a annular member 144 of Perspex which is bolted to the wall 142 by bolts 145 thereby holding the cylinder 140 in position. The member 144 carries a groove 146 on its inner face around the central aperture of the member 144, the groove 146 being shaped to receive the outer end of the cylinder 140. The outer face of the member 144 is formed to provide a flange 147 extending into the central aperture of the member 144. Covering the outer end of the cylinder 140 and held at its rim between the member 144 and the cylinder 140 is a circular diaphragm 148 of rubber or plastics material. Passing through the centre of the diaphragm 148 and clamped thereto on each side of the diaphragm 148 by a screw threaded bolt 149 and a washer 150 is a rod 151 which is screw threaded over its central portion to co-operate with the bolts 149. The inner end of the rod 151 carries a plug 152, the conically shaped end of which co-operates with the outlet 141 to control the tailings flow through the outlet. At its other end the rod 151 passes through the flange 147 and is connected with a solenoid control 153 that moves the rod 151, and thus the plug 152, in or out in response to the pressure recorded by a sensor (not shown) positioned in the uppermost cell of the receptacle to record the hydrostatic pressure therein.

In operation, an increase in the hydrostatic pressure in the uppermost cell of the receptacle causes the solenoid control 153 to move the rod 151, and thus the plug 152, outwards thereby increasing the rate of tailings outflow through the outlet 141. A decrease in the hydrostatic pressure produces the opposite effect.

I claim:

1. Apparatus for use in froth flotation which comprises:

a receptacle;
means for generation of bubbles in said receptacle;
means for dividing said receptacle to provide two or more flotation cells arranged one above another;
apertured passage means in said dividing means for the passage of froth upwardly through said dividing means from each lower cell into the adjacent upper cell; and
control means for each lower cell, said means being responsive to changes in the thickness of the froth layer in said lower cell and serving to maintain said thickness at a predetermined value.

2. Apparatus according to claim 1 which further comprises means which allows the passage of pulp downwardly from each upper cell into the respective adjacent lower cell.

3. Apparatus according to claim 1 wherein said control means regulates the passage of froth upwardly out of a lower cell.

4. Apparatus according to claim 1, wherein said dividing means has a plurality of apertures for the passage of froth therethrough.

5. Apparatus according to claim 4, wherein said apertures are of constant size and said control means regulates passage of pulp downwardly into the lower cell.

6. Apparatus according to claim 5, wherein said apertures are frustro-conical with the wider end of the aperture adjacent to the top of the lower cell.

7. Apparatus according to claim 5, wherein said control means comprises valve means responsive to a variation in the pressure difference between the bottom of an upper cell and the top of the respective lower cell, and acting on the pulp flow into the lower cell.

8. Apparatus according to claim 7, wherein said control means is external to said receptacle and comprises a weir and pressure responsive means controlling the rate of flow of pulp over said weir.

9. Apparatus according to claim 4, wherein said dividing means comprises a first set of rods arranged to provide fixed apertures between said rods; a second set of rods arranged above said first set; the rods of the second set being movable in relation to the first set in response to variations in the froth thickness of the lower cell and cooperating with said fixed apertures so that said movement controls the flow of froth through said apertures.

10. Apparatus according to claim 9, which further comprises means for preventing total restriction of said fixed apertures in said first set, by said second set.

11. The apparatus of claim 9 which further comprises additional means for the passage of pulp downwardly from each upper cell into the adjacent lower cell.

12. Apparatus according to claim 11, wherein said additional means is external to the receptacle and comprises an unrestricted passage means joining the lower cell and the upper cell.

13. Apparatus according to claim 11 wherein said additional means is internal to the receptacle and comprises a gap between an interior wall of the receptacle and said dividing means.

14. Apparatus according to claim 1, which further comprises an outlet for tailings at the bottom of said receptacle, said outlet being provided with control means which acts to control the rate of tailings outflow in response to a variation in the pressure in the uppermost cell in the receptacle to thereby correct any such variation and maintain a constant pulp head.

15. Apparatus according to claim 1 wherein said control means regulates passage of pulp downwardly into a lower cell.

16. Apparatus according to claim 15, wherein said control means additionally regulates passage of froth upwardly out of a lower cell.

17. A method of effecting froth flotation of particles in liquid suspension in a receptacle divided to provide two or more flotation cells arranged one above another which comprises passing froth upwardly from each lower cell into the adjacent upper cell while maintaining a constant predetermined thickness of the forth layer in each lower cell thereby inhibiting coalescence in said lower cell.

18. The method according to claim 17, wherein fresh reflux liquid is fed in at the top of the receptacle, pulp is passed downwardly from each upper cell into the next lower adjacent cell, and tailings are withdrawn at the bottom of the receptacle.

19. The method according to claim 18 wherein the cells are separated by a first set of rods arranged to provide a plurality of fixed apertures and a second set of rods arranged above said first set to restrict said apertures, the second set being movable in relation to the first in response to variations in the thickness of the froth layer in the lower cell, thereby varying the size of said apertures; said second set being of a form such that the total weight of the second set together with the liquid and the solids in the froth is equal to the weight of pulp displaced by the froth layer of the predetermined thickness.

20. The method according to claim 19, wherein the particles treated by froth flotation contain coal or a metalliferous ore.

21. The method according to claim 18 wherein said maintenance of the thickness of the froth layer in the lower cell is effected by regulation of the flow of pulp downwardly into said cell.

* * * * *